US007357468B2

(12) United States Patent
Hwang et al.

(10) Patent No.: US 7,357,468 B2
(45) Date of Patent: Apr. 15, 2008

(54) LOCATING STRUCTURE FOR A SLIDE ASSEMBLY

(75) Inventors: Shih-Long Hwang, Kaohsiung Hsien (TW); Ken-Ching Chen, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 137 days.

(21) Appl. No.: 11/334,449

(22) Filed: Jan. 19, 2006

(65) Prior Publication Data

US 2007/0164644 A1 Jul. 19, 2007

(51) Int. Cl.
*A47B 88/04* (2006.01)

(52) U.S. Cl. ..... 312/333; 312/334.8; 312/334.47; 384/21

(58) Field of Classification Search ..... 312/333, 312/334.1, 334.8, 334.44, 334.46, 334.47; 384/21, 22
See application file for complete search history.

(56) References Cited

U.S. PATENT DOCUMENTS 1,557,765 A * 10/1925 Nicholas ..... 198/634
2,528,910 A * 11/1950 Poe ..... 312/333
3,133,768 A 5/1964 Klakovich
3,258,299 A 6/1966 Meyer
3,371,968 A 3/1968 Loake
3,589,778 A 6/1971 Olson
3,650,578 A 3/1972 Del Vecchio et al.
4,560,212 A 12/1985 Papp et al.
4,988,214 A * 1/1991 Clement ..... 384/18
4,998,828 A 3/1991 Hobbs
5,203,620 A * 4/1993 McLennan ..... 312/334.46
5,344,228 A 9/1994 Kovarik et al.
5,417,490 A 5/1995 Hobbs et al.
5,484,197 A 1/1996 Hansen et al.
5,551,775 A 9/1996 Parvin
5,757,109 A 5/1998 Parvin
5,871,265 A 2/1999 Stewart et al.
6,056,379 A 5/2000 Weng
6,296,338 B1 10/2001 Stijns
6,350,001 B1 2/2002 Chu
6,390,574 B2 5/2002 Fraccaro
6,585,335 B2 7/2003 Hwang et al.
6,655,763 B2 12/2003 Judge et al.
6,702,412 B2 3/2004 Dobler et al.
6,705,689 B2 3/2004 Chen et al.
6,749,276 B2 * 6/2004 Judge et al. ..... 312/334.47

(Continued)

*Primary Examiner*—Janet M. Wilkens
*Assistant Examiner*—Mart K Kuhn
(74) *Attorney, Agent, or Firm*—Rosenberg, Klein & Lee

(57) ABSTRACT

A locating structure for a slide assembly operates in conjunction with a middle, an inner, and an outer rail with the inner rail sliding into the middle rail and the middle rail sliding in the outer rail and includes a linking member, a locating member and an elastic member. Both the linking member and the locating member are pivotally connected to the middle rail. A first protruding wall containing a blocking portion and a slope is disposed on the inner rail. A second protruding wall containing a retaining portion and a slope is disposed on the outer rail. The linking member includes a constraining end and a release end. The locating member includes a release end and a fixation end. The elastic member is fixed to the middle rail to hold against the release end of the linking member and the fixation end of the locating member.

5 Claims, 7 Drawing Sheets

U.S. PATENT DOCUMENTS

| | | | | |
|---|---|---|---|---|
| 6,805,418 | B2 | 10/2004 | Milligan | |
| 6,899,408 | B2 | 5/2005 | Chen et al. | |
| 6,935,710 | B2 * | 8/2005 | Chen et al. | 312/333 |
| 7,210,752 | B2 * | 5/2007 | Dubon | 312/333 |
| 2003/0052580 | A1 | 3/2003 | Dobler | |
| 2003/0111942 | A1 | 6/2003 | Judge | |
| 2003/0122460 | A1 | 7/2003 | Juen | |
| 2004/0174103 | A1 | 9/2004 | Yang | |
| 2004/0239220 | A1 | 12/2004 | Yang | |
| 2005/0116594 | A1 | 6/2005 | Barry, Jr. | |
| 2005/0180667 | A1 | 8/2005 | Chen | |

* cited by examiner

LOCATING STRUCTURE FOR A SLIDE ASSEMBLY

BACKGROUND OF THE INVENTION (a) Field of the Invention

The present invention relates to a locating structure for a slide assembly, and more particularly to one that synchronously extends a middle rail and an inner rail, releases the inner rail from the middle rail to fully extend when the latter is secured in position in relation to an outer rail, and retracts in sequence the inner rail and the middle rail while retracting the slide.

(b) Description of the Prior Art

Conventional retractable slides generally available in the market to be mounted to a drawer or similar suspension systems are usually provided in a two-stage slide containing an inner rail and an outer rail or in a three-stage slide containing an inner rail, a middle rail, and an outer rail. A locating system is usually provided in the case of a three-stage slide at the end of the travel of the slide so to prevent the inner rail or the middle rail to be retreated into the outer rail. Given with the consideration of facilitating pull of the inner and the middle rails in sequence from the outer rail, a synchronous sliding device may be provided among the inner, the middle, and the outer rails as applicable. For the purpose of extension locating for the middle and the outer rails in a three-stage slide, there are many prior arts disclosed in U.S. patents including U.S. Pat. Nos. 3,133,768; 3,258,299; 3,371,968; 3,589,778; 3,650,578; 4,560,212; 4,998,828; 5,417,490; 5,484,197; 5,551,775; 5,757,109; 5,871,265; 6,350,001 B1; 6,296,338 B1; 6,350,001 B1; 6,390,574 B2; 6,585,335 B2; 6,655,763 B2; 6,702,412 B2; 6,705,689 B2; 6,749,276 B2; 6,805,418 B2; and 6,899,408 B2; and U.S. Patent Application Nos. U.S. 2003/0052580 A1; U.S. 2003/0111942 A1; U.S. 2004/0174103 A1; U.S. 2004/0239220 A1; U.S. 2005/0116594 A1; and U.S. 2005/0180667 A1 as published. Several of those U.S. Patents cited above including U.S. Pat. Nos. 6,585,335 B2; 6,705,689 B2; 6,899,408 B2; and U.S. 2005/0180667 A1 are the R&D technologies of the same applicant of the present invention.

In the design of a linking mechanism related to the art of synchronously displacement of the middle rail when extending from the slide together with the inner rail, similar synchronous function is taught in the extension locating structures in several prior art of those U.S. Patents cited above, and U.S. Pat. Nos. 5,344,228, 6,056,379 and Application No. 2003/0122460 A1.

Depending on the purpose of application, each slide calls for its mechanical needs. It is taken for granted in the competition of the trade to develop products that meet the market demands. Therefore, the prevent invention is created for better justifying and more economic benefits in the planning of members, operation and manufacturing.

SUMMARY OF THE INVENTION

The primary purpose of the present invention is to provide a locating structure for a slide assembly to synchronously extend and locate a middle rail and an inner rail of the slide in position; and to receive in sequence the inner rail and the middle rail into an outer rail of the slide when retracted.

To achieve the purpose, the present invention operates in conjunction with the middle rail, the inner rail, and the outer rail of the slide with the inner rail sliding in the middle rail and the middle rail sliding in the out rail, and further includes a linking member, a locating member, and an elastic member. Both the linking member and the locating member are pivoted to the middle rail. A first protruding wall disposed to the inner rail is provided with a blocking portion, and a second protruding wall disposed to the outer rail is provided with a retaining portion. The linking member includes a constraining end and a release end, and the locating member includes a release end and a fixation end. The elastic member is fixed to the middle rail to respectively restrict the release end of the linking member and the fixation end of the locating member. The constraining end of the linking member is at where in relation to the blocking portion of the first protruding wall of the inner rail; and the fixation end of the locating member, to the retaining portion of the second protruding wall of the outer rail. The first protruding wall includes a slope in relation to the release end of the locating member. The second protruding wall contains a slope in relation to the release end of the linking member. Accordingly, the present invention provides advantages of having a locating structure within a limited space available from the slide to contain independent members to provide synchronous and locating functions as desired from the same location in a more reasonable and economic design and arrangement of elements of the locating structure adapted the slide for cost reduction and longer service life.

DETAILED DESCRIPTION OF THE PREFERRED EMBODIMENTS

Figure 1:
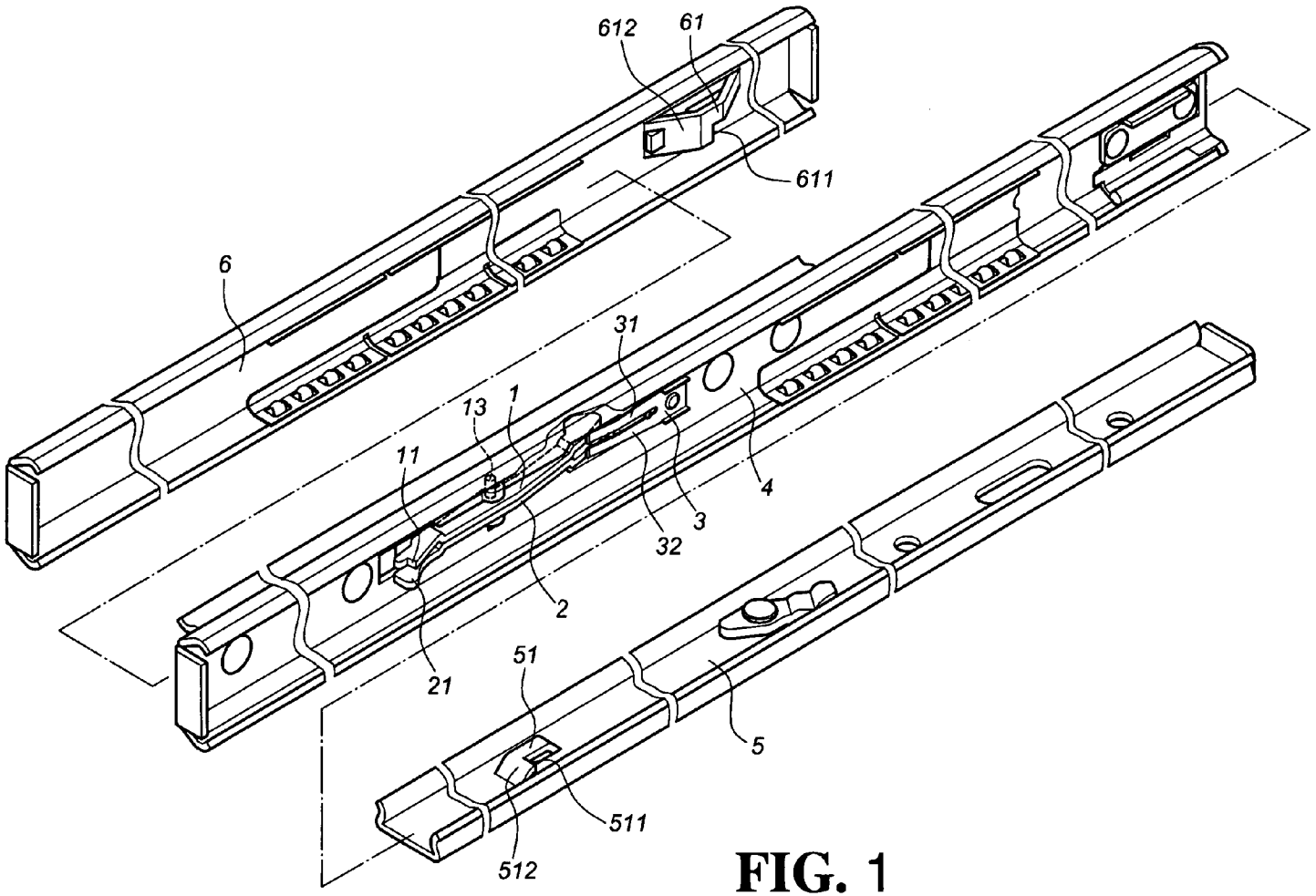
FIG. 1 is an exploded view of a preferred embodiment of the present invention applied to a three-stage slide.
Figure 2:
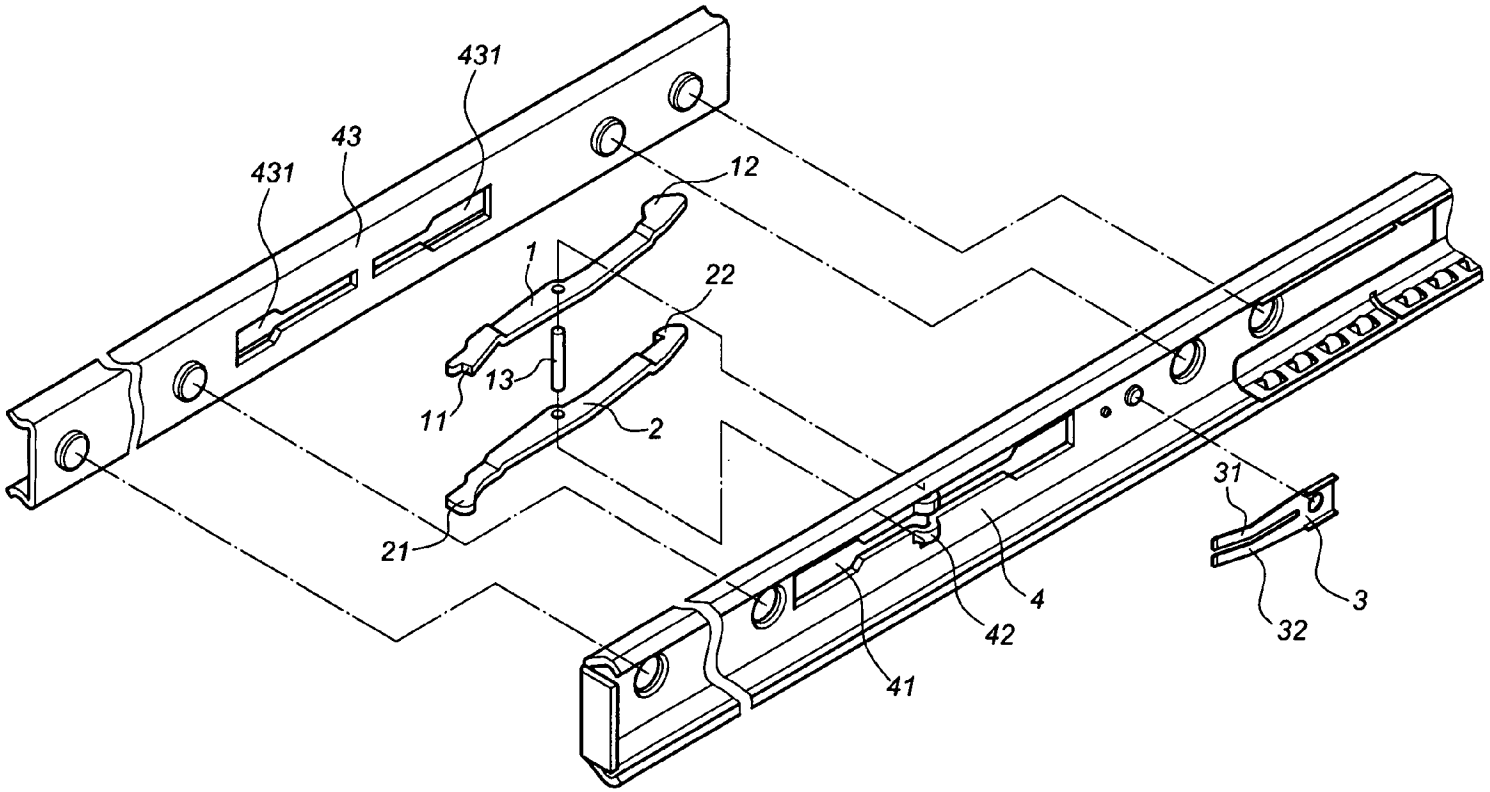
FIG. 2 is an exploded view of the preferred embodiment of the present invention.
Figure 3:
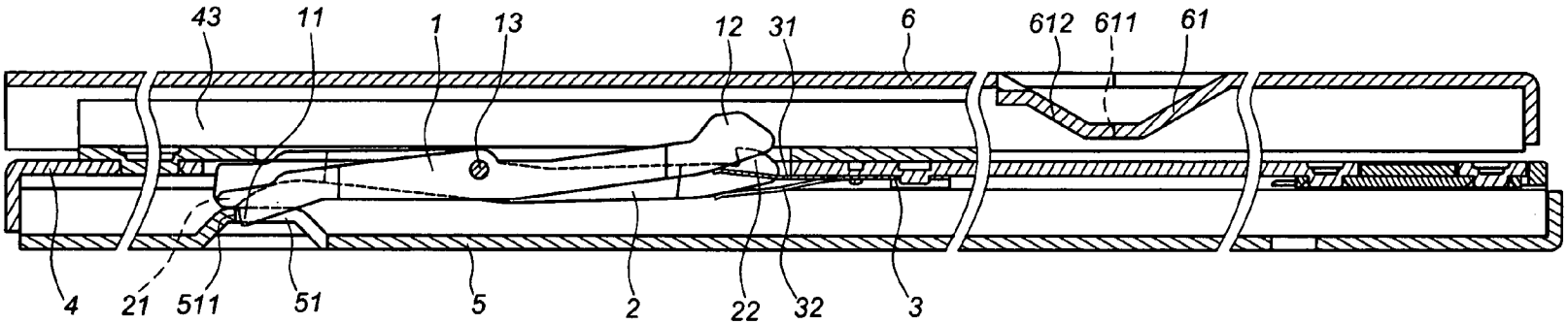
FIG. 3 is a sectional view showing that the preferred embodiment of the present invention is fully retracted.

Referring to FIGS. 1 through 3, a preferred embodiment of the present invention operates in conjunction with a middle rail (4), an inner rail (5), and an outer rail (6) with the inner rail (5) sliding into the middle rail (4) and the middle rail (4) sliding into the outer rail (6), and includes a linking member (1), a locating member (2), and an elastic member (3).

Both the linking member (1) and the locating member (2) are pivotally connected to the middle rail (4) by having a pivoting pin (13) penetrating through the middle sections of the linking member (1) and the locating member (2). A secondary rail (43) is fixed to the middle rail (4). Both the middle rail (4) and the secondary rail (43) are respectively provided with channels (41, 431) to accommodate the linking member (1) and the locating member (2). The pivoting pin (13) penetrates through a pair of pivoting bases (42) in a semi-circular form disposed on the middle rail (4) and is pivotally connected to the middle rail (4) by being clamped between the middle rail (4) and the secondary rail (43). The inner rail (5) is provided with a first protruding wall (51). The first protruding wall (51) is provided with a blocking portion (511) and a slope (512). A second protruding wall (61) is provided to the outer rail (6) and includes a retaining portion (611) and a slope (612). The linking member (1) includes a constraining end (11) and a release end (12). The locating member (2) includes a release end (21) and a fixation end (22). The elastic member (3) is fixed to the middle rail (4) and provided with a first elastic tag (31) and a second elastic tag (32) to respectively restrict the release end (12) of the linking member (1) and the fixation end (22) of the locating member (2). The constraining end (11) of the linking member (1) is disposed at where in relation to the blocking portion (511) of the first protruding wall (51) of the inner rail (5); and the release end (12) of the linking member (1), to the slope (612) of the second protruding wall (61) of the outer rail (6). The fixed end (22) of the locating member (2) is disposed at where in relation to the retaining portion (611) of the second protruding wall (61); and the release end (21) of the locating member (2), to the slope (512) of the first protruding wall (51).

Figure 4:
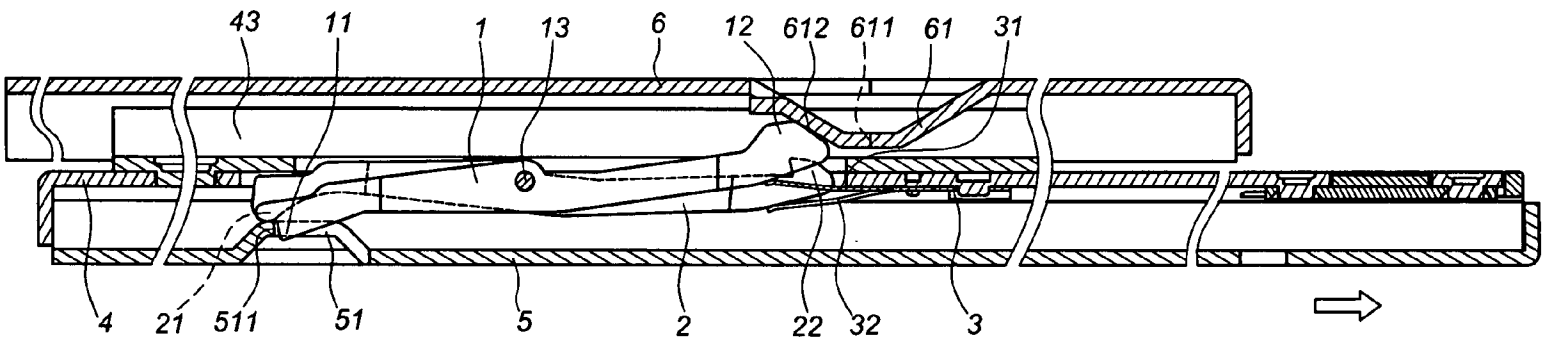
FIG. 4 is a schematic view showing an operating status of the preferred embodiment of the present invention with an inner rail being pulled out.
Figure 5:
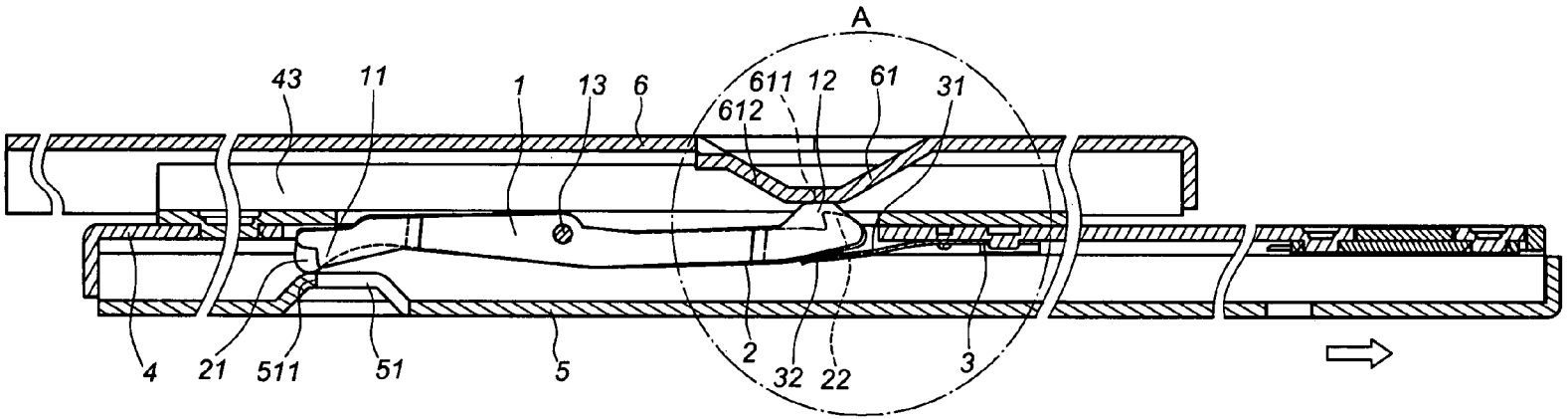
FIG. 5 is a schematic view showing another operating status of the preferred embodiment of the present invention with the inner rail being released form a middle rail.
Figure 6:
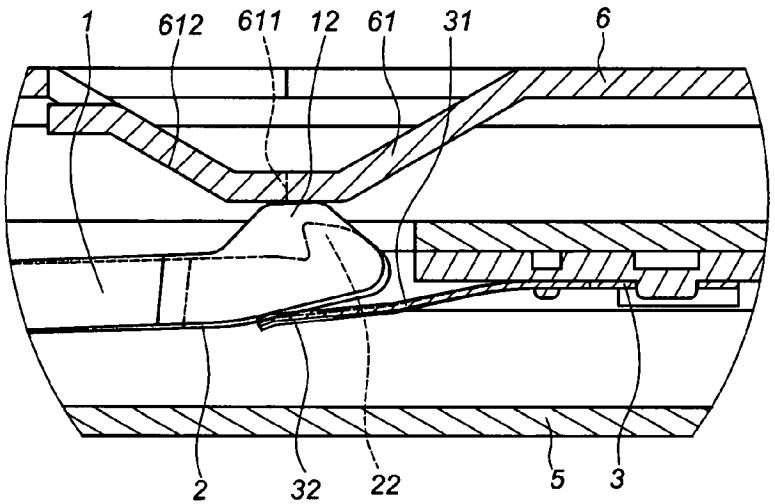
FIG. 6 is an enlarged view of a local part of A taken from FIG. 5.
Figure 7:
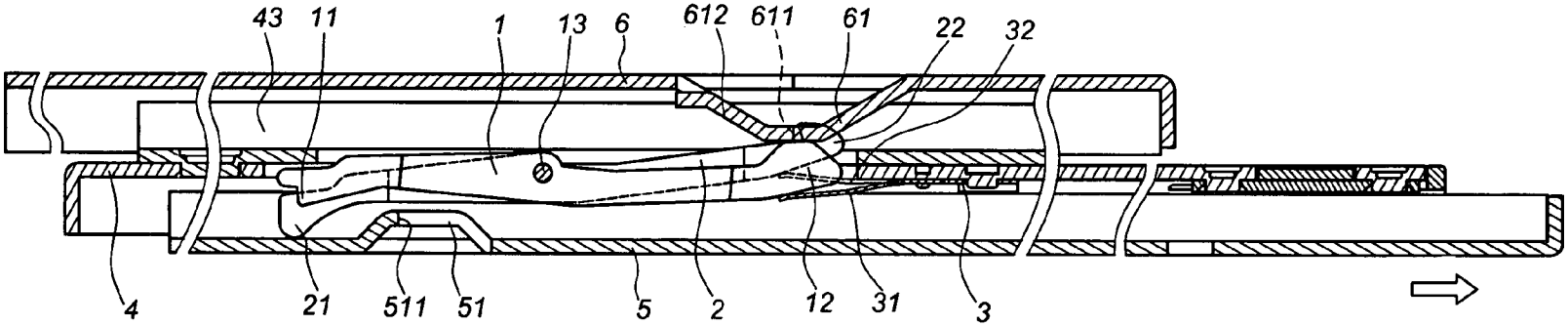
FIG. 7 is a schematic view showing another operating status yet of the preferred embodiment of the present invention with both the middle and the outer rails extending relatively to be secured in position while the inner rail further extended.
Figure 8:
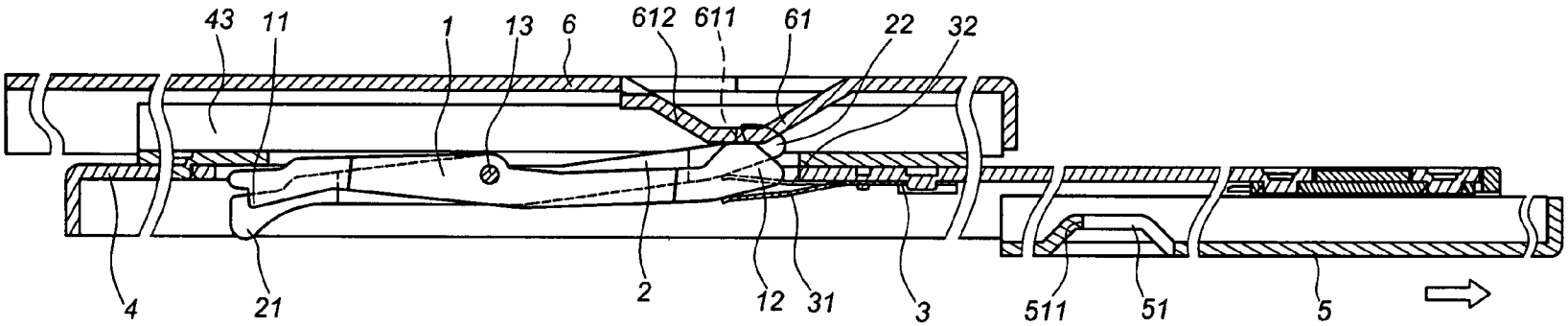
FIG. 8 is a schematic view showing another operating status yet of the preferred embodiment of the present invention with the inner rail fully extended.

FIGS. 3 through 9 respectively show the operating status of the preferred embodiment of the present invention. As illustrated in FIG. 3, the slide is fully retracted. The constraining end (11) of the linking member (1) holds against the blocking portion (511) of the first protruding wall (51) of the inner rail (5), while the first protruding wall (51) lifts up the release end (21) of the locating member (2). As illustrated in FIG. 4, when the inner wall (5) is pulled to extend, the blocking portion (511) of the first protruding wall (51) and the constraining end (11) of the linking member (1) draw out the middle rail (4) at the same time. When the inner wall (5) extends to a given point as illustrated in FIGS. 5 and 6, the second protruding wall (61) with the slope (612) lifts up the release end (12) of the linking member (1) to release the constraining end (11) of the linking member (1) from the blocking portion (511) of the first protruding wall (51) so to be free from its constrained status in relation with the inner rail (5). Now referring to FIG. 7, the inner rail (5) allows further extension to clear the first protruding wall (51) out of the release end (21) of the locating member (2) for the fixation end (22) of the locating member (2) to hook the retaining portion (611) of the second protruding wall (61) when the second elastic tag (32) of the elastic member (3) holds against the fixation end (22) of the locating member (2). The inner rail (5) further extends as illustrated in FIG. 8 for the middle rail (4) to be secured in position relatively to the outer rail (6) by having the fixation end (22) of the locating member (2) to hold against the retaining portion (611) of the second protruding wall (61) before the inner rail (5) continues to extend to its full capacity.

Figure 9:
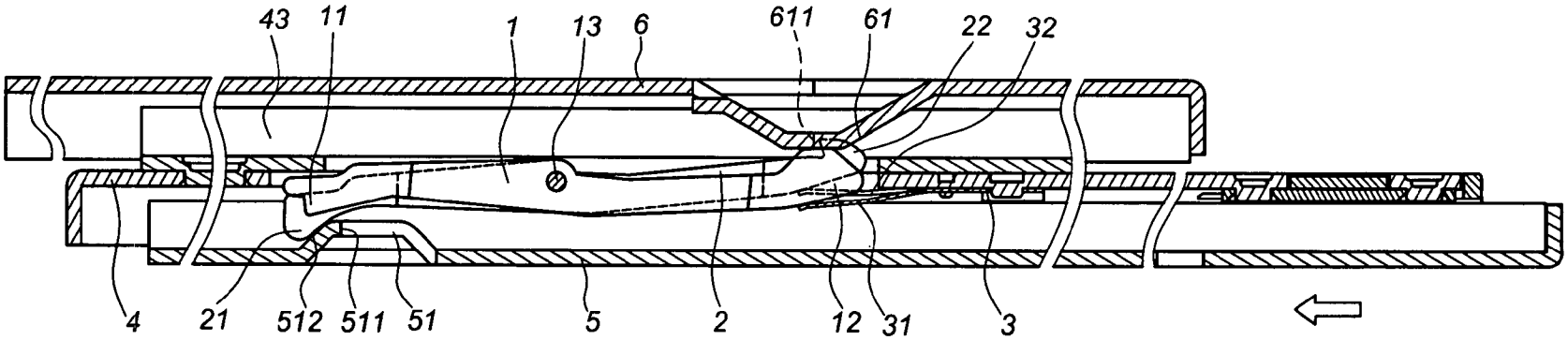
FIG. 9 is a schematic view showing another operating status yet of the preferred embodiment of the present invention fully retracted and released from the middle and the outer rails.

When the inner rail (5) is pushed in to retract the slide as illustrated in FIG. 9, the first protruding wall (51) with the slope (512) of the inner rail (5) pushes against the release end (21) of the locating member (2) for the fixation end (22) of the locating member (2) to disengage from the retaining portion (611) of the second protruding wall (61) of the outer rail (6). Thus the middle rail (4) is retracted, and finally the slide is fully retracted as illustrated in FIG. 1.

Figure 10:
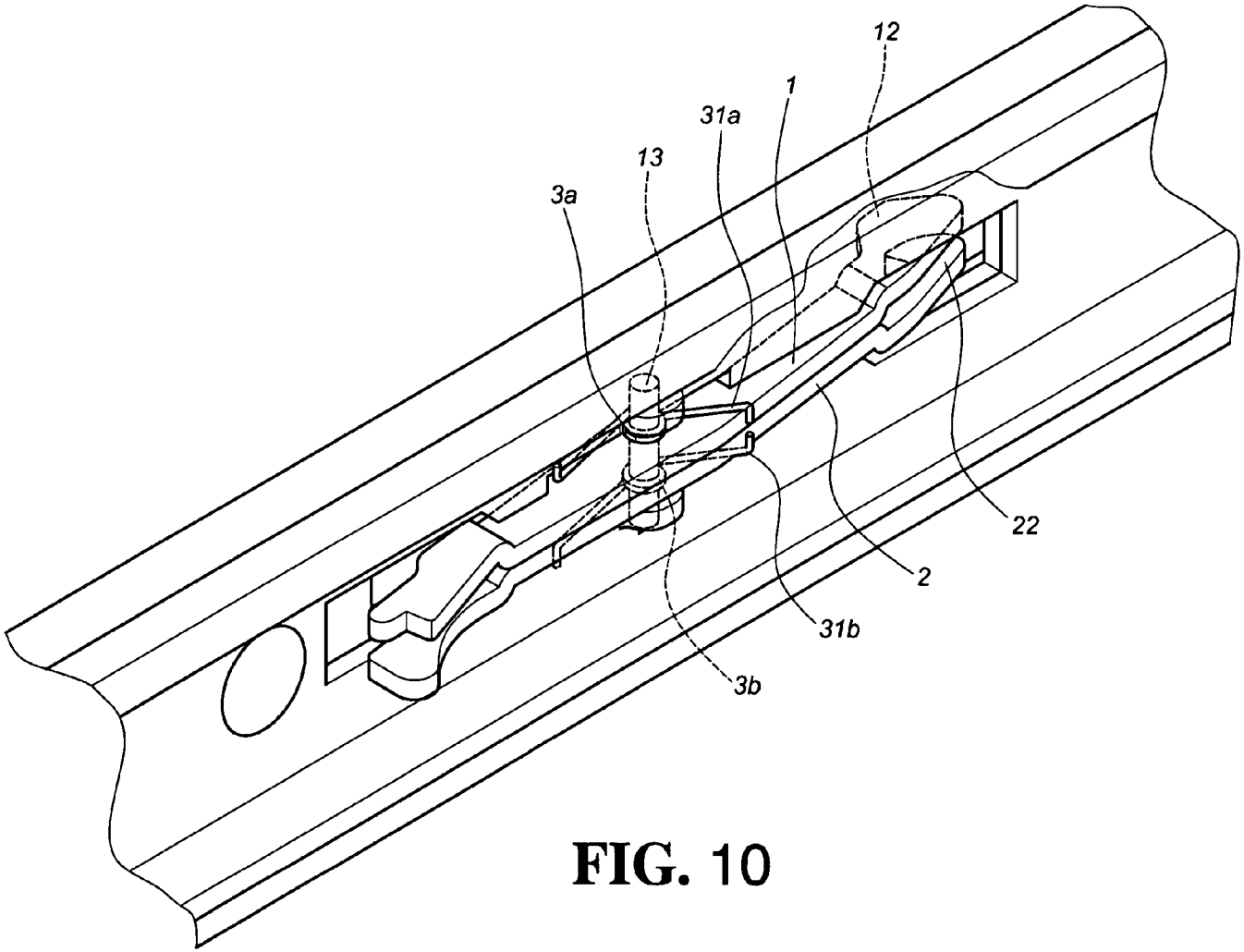
FIG. 10 is a schematic view showing an equivalent change to a local structure of the preferred embodiment of the present invention.

Furthermore, as illustrated in FIG. 10, a first torsion spring (3*a*) and a second torsion spring (3*b*) are provided and inserted on the pivoting ping (13) in the art of applying the elasticity from the elastic member (3) to the linking member (1) and the locating member (2). An active end (31*a*) of the first torsion spring (3*a*) applies its pressure against the leverage on the side of the linking member (1) provided with the release end (12) while an active end (31*b*) of the second torsion spring (3*b*) applies its pressure against the leverage on the side of the locating member (2) provided with the fixation end (12).

What is claimed is:

1. A locating structure for a slide assembly comprising:

a middle rail;

an inner rail slidingly engaged with said middle rail;

an outer rail, wherein the inner rail slides into the middle rail and the middle rail slides into the outer rail;

a linking member;

a locating member;

an elastic member, wherein the linking member and the locating member are disposed in a through-passage of the middle rail and being pivotally connected to the middle rail, the linking member and locating member pivoting orthogonally through a horizontal plane of the middle rail, and selectively engaging with the inner rail and the outer rail;

a first protruding wall containing a blocking portion being disposed on the inner rail;

a second protruding wall containing a retaining portion being disposed on the outer rail, wherein the linking member including a constraining end and a release end, the locating member including a release end and a fixation end; the elastic member being disposed on the middle rail to respectively hold against the release end of the linking member and the fixation end of the locating member the constraining end of the linking member corresponding to the blocking portion of the first protruding wall of the inner wall, and the fixation end of the locating member corresponding to the retaining portion of the second protruding wall.

2. The locating structure for a slide assembly of claim 1, wherein the first protruding wall includes a slope in relation to the release end of the locating member.

3. The locating structure for a slide assembly of claim 1, wherein the second protruding wall includes a slope in relation to the release end of the locating member.

4. The locating structure for a slide assembly of claim 1, wherein the elastic member includes a first elastic tag and a second elastic tag to respectively hold against the release end of the linking member and the fixation end of the locating member.

5. The locating structure for a slide assembly of claim 1, wherein the elastic member is inserted to a pivoting pin with a first torsion spring and a second torsion spring; an active end of the first torsion spring applies pressure on the release end of the linking member; and an active end of the second torsion spring applies pressure on the fixation end of the locating member.

* * * * *